US007628692B2

(12) United States Patent
Kaminkow

(10) Patent No.: US 7,628,692 B2
(45) Date of Patent: Dec. 8, 2009

(54) GAMING DEVICE HAVING AN INPUT DEVICE WITH A DISPLAY DEVICE

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 659 days.

(21) Appl. No.: 10/227,085

(22) Filed: Aug. 22, 2002

(65) Prior Publication Data

US 2004/0038725 A1 Feb. 26, 2004

(51) Int. Cl.
*A63F 9/24* (2006.01)

(52) U.S. Cl. ..... 463/20; 463/37

(58) Field of Classification Search ..... 463/1, 463/9–13, 30, 31, 36, 37
See application file for complete search history.

(56) References Cited

U.S. PATENT DOCUMENTS 4,624,459 A 11/1986 Kaufman
4,856,787 A * 8/1989 Itkis ..... 273/237
4,897,651 A 1/1990 DeMonte
5,033,744 A * 7/1991 Bridgeman et al. ..... 463/13
5,134,505 A 7/1992 Tanaka et al.
5,233,167 A 8/1993 Markman et al.
5,278,362 A * 1/1994 Ohashi ..... 200/5 A
5,393,057 A * 2/1995 Marnell, II ..... 463/13
5,542,669 A * 8/1996 Charron et al. ..... 463/13
5,695,402 A 12/1997 Stupah
5,770,914 A 6/1998 Pease et al.
5,833,536 A 11/1998 Davids et al.
5,964,463 A 10/1999 Moore, Jr.
6,004,207 A 12/1999 Wilson, Jr. et al.
6,012,982 A 1/2000 Piechowiak et al.
6,014,131 A 1/2000 Barry et al.
6,015,346 A 1/2000 Bennett
6,056,642 A * 5/2000 Bennett ..... 463/20
6,102,394 A 8/2000 Wurz et al.
6,117,010 A 9/2000 Canterbury et al.
6,159,097 A 12/2000 Gura
6,159,098 A 12/2000 Slomiany et al.

(Continued)

FOREIGN PATENT DOCUMENTS

EP 0232137 8/1987

(Continued)

OTHER PUBLICATIONS

LED Status Indicator Panels, D.G. Controls Limited, printed on May 15, 2001.

(Continued)

*Primary Examiner*—Dmitry Suhol
*Assistant Examiner*—Omkar Deodhar
(74) *Attorney, Agent, or Firm*—K&L Gates LLP

(57) ABSTRACT

A gaming device which includes at least one input device having a game state indicator. The input device is movable between a plurality of physical positions and enables players to make inputs by moving the input device to one of said plurality of positions. The game state indicator indicates game state information to the player such as the remaining number of activations provided to the player. This gaming device provides players with increased information, convenience and enjoyment when playing gaming devices.

57 Claims, 12 Drawing Sheets

U.S. PATENT DOCUMENTS

| | | | | |
|---|---|---|---|---|
| 6,174,233 | B1 | 1/2001 | Sunaga et al. | |
| 6,190,255 | B1 | 2/2001 | Thomas et al. | |
| 6,203,430 | B1 | 3/2001 | Walker et al. | |
| 6,231,442 | B1 | 5/2001 | Mayeroff | |
| 6,234,897 | B1 | 5/2001 | Frohm et al. | |
| 6,261,177 | B1 | 7/2001 | Bennett | |
| 6,309,300 | B1 | 10/2001 | Glavich | |
| 6,315,664 | B1 | 11/2001 | Baerlocher et al. | |
| 6,346,043 | B1 | 2/2002 | Colin et al. | |
| 6,347,795 | B1 | 2/2002 | DeLeljer | |
| 6,347,996 | B1 | 2/2002 | Gilmore et al. | |
| 6,364,767 | B1 | 4/2002 | Brossard et al. | |
| 6,409,595 | B1 | 6/2002 | Uihlein et al. | |
| 6,443,837 | B1 | 9/2002 | Jaffe et al. | |
| 6,454,649 | B1 | 9/2002 | Mattice et al. | |
| 6,464,582 | B1 | 10/2002 | Baerlocher et al. | |
| 6,686,906 | B2 * | 2/2004 | Salminen et al. | 345/169 |
| 6,692,353 | B2 * | 2/2004 | Walker et al. | 463/16 |
| 6,798,359 | B1 | 9/2004 | Ivancic | |
| 2003/0064783 | A1 * | 4/2003 | Baerlocher et al. | 463/20 |
| 2004/0038725 | A1 | 2/2004 | Kaminkow | |
| 2005/0050005 | A1 | 3/2005 | Ivancic | |

FOREIGN PATENT DOCUMENTS

| | | |
|---|---|---|
| GB | 2150722 | 7/1985 |
| WO | WO 8501596 | 4/1985 |
| WO | WO 94/24683 | 10/1994 |

OTHER PUBLICATIONS

Multi-Color Poly-Leds™, Lumex Product Gallery, printed on Aug. 22, 2001.

Dot Matrix Displays, Lumex Product Gallery, printed on Aug. 22, 2001.

LED lights, topbulb, printed on Aug. 22, 2001.

Gaming & Amusement advertisement, written by Starpoint Electronics Ltd., available prior to Aug. 22, 2002.

* cited by examiner

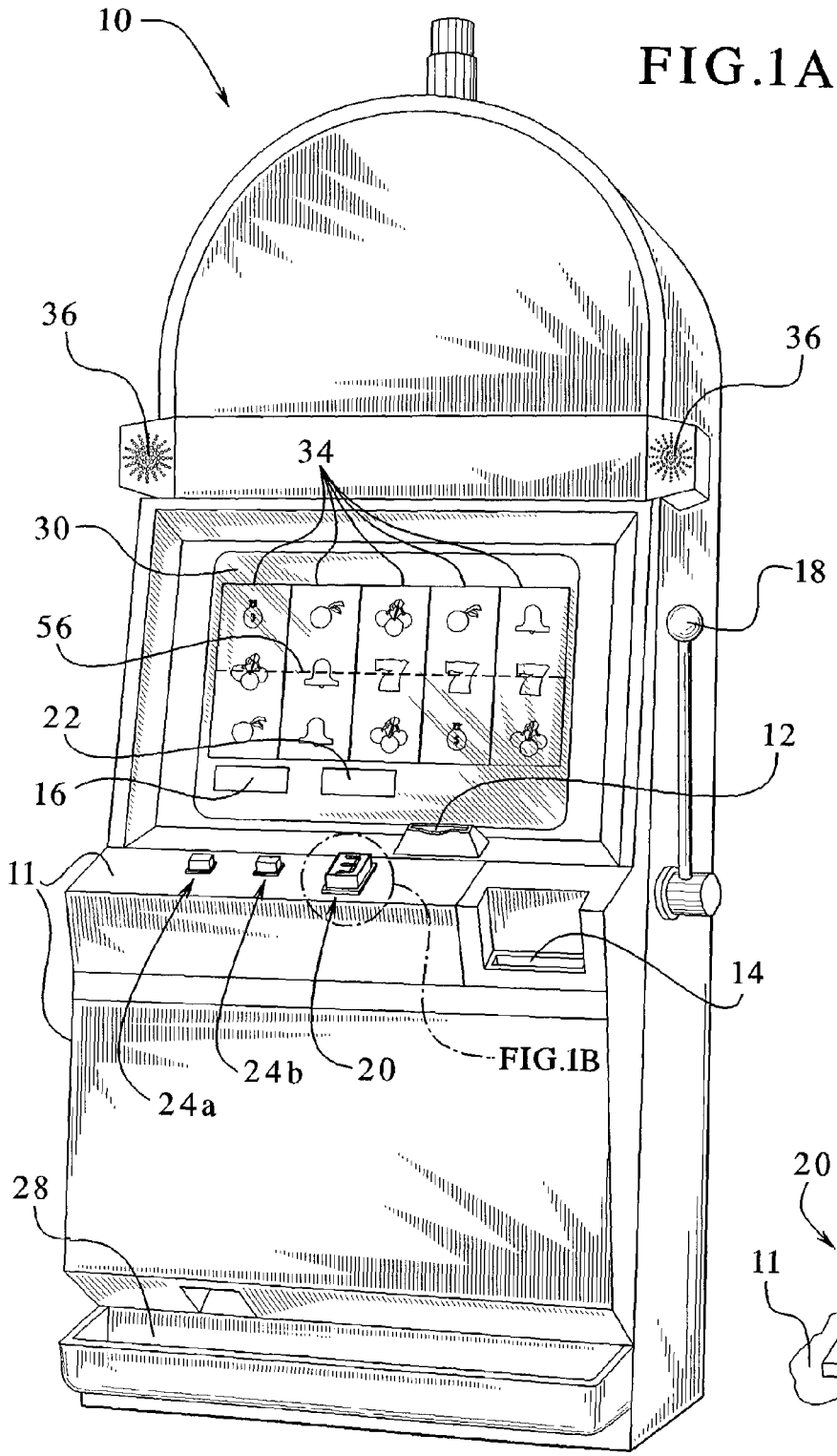
FIG.1A
FIG.1B
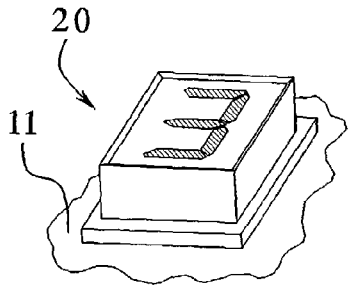

GAMING DEVICE HAVING AN INPUT DEVICE WITH A DISPLAY DEVICE

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Contemporary gaming machines, such as slot machines, video poker machines, video blackjack machines and keno machines, have various input devices and displays. Players use the input devices to make various types of inputs. A player can use input devices, such as input buttons, to make wagers, spin reels, rotate wheels, draw cards, select symbols and accept or decline offers.

In known gaming devices, certain input buttons are labeled to indicate their purpose to the player. For example, the indicia "CASH OUT" is affixed on or adjacent to the cash out button. Known gaming devices also have input devices which indicate information to the player such as an illuminable button which enables the player to select which lines to bet or to cause a reel to spin. To increase player enjoyment and excitement, it is desirable to provide players with new gaming devices with new and different input devices.

SUMMARY OF THE INVENTION

The present invention includes a gaming device which has an input device with a game state indicator. The input device, which in one preferred embodiment includes a depressible button, enables the player to activate play, set a game parameter or make any other suitable input to the gaming device. In addition, the input device indicates game state information to the player. Preferably, there is a logical relationship between the function of the input device and the indicated game state information. For example, if the input device is a play activator, the input device preferably indicates a quantity of plays or attempts which are available to or remaining for the player.

In one embodiment, the game state indicator includes a light fixture which can display a plurality of different symbols to the player. It is preferable that the light fixture includes a plurality of light emitting diode (LED) light sources, each of which has an on state and an off state. The light fixture is thus capable of displaying numerals, letters and other symbols which indicate game state information to a player.

In another embodiment, the game state indicator includes a suitable display panel, such as a screen, which produces symbols or images, such as a numeric image. The display panel can include any suitable display device capable or producing or generating images, including, but not limited to, a computer screen, a liquid crystal diode (LCD) screen, a video screen, a monitor screen or a flat screen.

In another embodiment, the game state indicator includes a plurality of light sources, preferably arranged in a matrix, grid or any other suitable array. Each light source has an on state and an off state which is controlled by the gaming device processor. The processor uses the light sources to form symbols, such as numerals.

In another embodiment, the game state indicator includes a relatively small number of light sources arranged in a grid or matrix. Each of the light sources has an on state and an off state. The game state indicator indicates game state quantities to the player by controlling the on and off states of the light sources. Preferably, at any point during a game, the total number of illuminated light sources indicates a game state quantity to the player.

As described above, in one embodiment the input device of the present invention is a play activator. In operation, when the player initiates a game, for example, the gaming device processor may provide the player with three chances to reach a winning combination of symbols on the reels. In such case, the play activator may initially display the numeral three to the player. After the player's first attempt, the play activator displays the numeral two. After the player's second attempt, the play activator displays the numeral one. Finally, after the player's third attempt, the play activator displays the numeral zero. Each time the player activates the play activator, the play activator indicates the current quantity of attempts remaining for the player.

The gaming device of the present invention brings additional functionality to input devices. In particular, the input device of the present invention enables the player to make inputs and also indicates game state information to the player. Preferably, when the player activates the input device, certain game state information changes, and the input device displays the current game state information. For example, if a player exhausts a play opportunity by activating the input device, the input device preferably displays a symbol which reflects a loss in that play opportunity. The gaming device of the present invention provides players with an increase in convenience and game information and generally enhances the playing experience.

It is therefore an advantage of the present invention to provide a gaming device having an input device with a game state indicator.

Another advantage of the present invention is to provide an input device which indicates game state information to the player.

Yet another advantage of the present invention is to provide a gaming device having an input device which, under the control of a processor, displays symbols indicative of game state information.

Still another advantage of the present invention is to assist a player in remaining aware of variable game state information throughout a game.

Another advantage of the present invention is to increase the ease in operating a gaming device.

Additional features and advantages of the present invention are described in, and will be apparent from, the following Detailed Description of the Invention and the figures.

BRIEF DESCRIPTION OF THE FIGURES

FIG. 1A is a perspective view of one embodiment of the gaming device of the present invention.

FIG. 1B is an enlarged perspective view of one embodiment of the input device (removed from the gaming device) of the present invention.

DETAILED DESCRIPTION OF THE INVENTION

Gaming Device and Electronics

Figure 2:
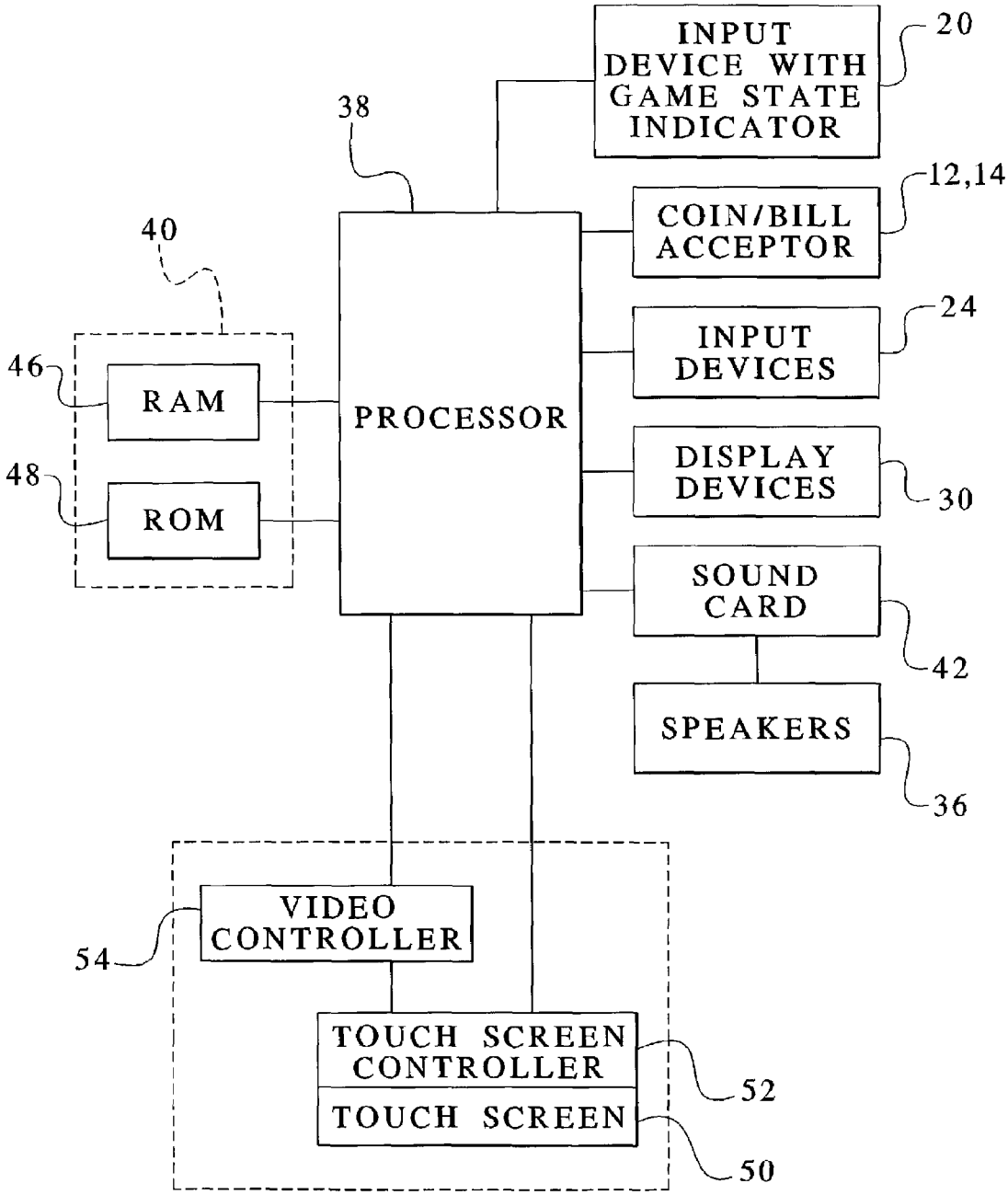
FIG. 2 is a schematic block diagram of the electronic configuration of one embodiment of the gaming device of the present invention.

Referring now to the drawings, one embodiment of the gaming device of the present invention is illustrated in FIG. 1A and indicated by numeral 10. The cabinet 11 of gaming device 10 is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display configurations. Gaming device 10 can incorporate any game apparatus for operating any base or primary wager game such as slot, blackjack, poker and keno, any of their secondary or bonus game triggering events and any of their secondary or bonus games. The symbols and indicia used on and in gaming device 10 may be in mechanical, electrical or video form.

As illustrated in FIG. 1A, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. In one embodiment, when a player inserts money in gaming device 10, a number of credits corresponding to the amount deposited is shown in a credit display 16. After depositing the appropriate amount of money, a player can begin the game by pulling arm 18 or pushing one of the input devices 20, 24*a* or 24*b*. Input devices 24*a* and 24*b* are generally referred to herein as input device 24. Input devices 20 and 24 can function as play activators, bet one buttons, cash out buttons, or the input devices 20 and 24 can have other suitable functions which enable the player to produce input signals for operating the gaming device. In addition to this functionality, input device 20 also indicates game state information to players as illustrated in FIG. 1B and further described below.

As shown in FIG. 1A, gaming device 10 also includes a bet display 22. The player can place a bet by pushing input device 20 or 24. The player can increase the bet by one credit each time the player pushes input device 20 or 24. In one embodiment, when the player pushes input device 20 or 24, the number of credits shown in the credit display 16 decreases by one, and the number of credits shown in the bet display 22 increases by one. In another embodiment described below, the input device 20 indicates the quantity of bets made.

A player may cash out and thereby receive a number of coins corresponding to the number of remaining credits by pushing input device 20 or 24. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, but other embodiments (not shown) can include both a central display device and an upper display device. As illustrated in FIG. 1A, gaming device 10 displays a plurality of reels 34, such as three to five reels 34 in mechanical or video form at the display device 30. However, it should be appreciated that the display devices can display any suitable game apparatus or any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor. Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

As illustrated in FIG. 2, the general electronic configuration of gaming device 10 preferably includes: a processor 38; a memory device or data storage device 40 for storing program code or other data; a display device 30; a sound card 42; a plurality of speakers 36; and input devices 20 and 24. The processor 38 is preferably a microprocessor or microcontroller-based platform which is capable of displaying images, symbols and other indicia such as images of people, characters, places, things and faces of cards. The data storage device 40 can include random access memory (RAM) 46 for storing event data, game state data, game state quantities, input availability data, other input data or other data generated or used during a particular game. The data storage device 40 can also include read only memory (ROM) 48 for storing program code which controls the gaming device 10 so that it plays a particular game in accordance with applicable game rules and pay tables.

As illustrated in FIG. 2, preferably the player uses input device 20 or 24 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate locations. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and data storage device 40 are preferable implementations of the present invention, the present invention can also be implemented using one or more application-specific integrated circuits (ASIC's) or other hardwired devices, or using mechanical devices (collectively or alternatively referred to herein as a "processor"). Furthermore, although the processor 38 and data storage device 40 preferably reside on each gaming device 10 unit, it is possible to provide some or all of their functions through a data network at a central location such as a network server for communication to a playing station such as over a local area network (LAN), wide area network (WAN), Internet connection, microwave link, and the like. The processor 38 and memory device 40 is at times generally referred to herein as the computer or controller.

With reference to FIGS. 1A, 1B and 2, to operate the gaming device 10 in one embodiment the player must insert the appropriate amount of money, tokens or otherwise currency at coin slot 12 or bill acceptor 14 and then pull the arm 18 or push the input device 20 or 24. The reels 34 will then begin to spin. Eventually, the reels 34 will come to a stop. As long as the player has credits remaining, the player can activate input device 20 or 24 again and cause the reels 34 to spin again. Depending upon where the reels 34 stop, the player may or may not win additional credits.

In addition to winning credits in this manner, the gaming device 10 may also give players the opportunity to win credits in a bonus round. This type of gaming device 10 will include a program which will automatically begin a bonus round when the player has achieved a qualifying condition in the game. This qualifying condition can be a particular arrangement of one or more indicia on a display device. The gaming device 10 may use a video-based display device 30 to enable the player to play the bonus round. As illustrated in the five reel slot game shown in FIG. 1A, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Input Device

As illustrated in FIGS. 1A to 10E, in one embodiment of the present invention, gaming device 10 includes a mechanical input device 20 which enables the player to produce an input for the gaming device 10 and which also indicates to the player certain game state information. The game state information can include a quantity of available inputs, a quantity of bets placed, a quantity of remaining credits, a payline specification or any other information related to any other game state, variable, parameter or characteristic.

Preferably, the gaming device 10 includes one or more mechanical input devices 20, each one having a predetermined purpose associated with the game state information indicated. For example, a mechanical play input device 20 may be a play activator which indicates the quantity of attempts remaining for a player, a mechanical bet input device 20 may be a bet setter which indicates the quantity of bets placed by the player, a mechanical cash-out input device 20 may be a cash-out activator which indicates the player's balance of credits, a mechanical payline input device 20 may be a payline setter which indicates the paylines set by the player, may be a game variable setter which enables the player to set any suitable variable for playing the game, or any other suitable type of mechanical input device 20. It is preferable that the input device 10 indicates any such game state information by forming and displaying a suitable symbol to the player. The symbol can include a numeral, letter, sign, a pictorial symbol or a graphical representation of any person, place or thing.

In one embodiment, the input device 20 includes: (a) an actuation member 100 which is movable between a depressed position and an extended position; (b) a securing member 102 which connects the actuation member 100 to the cabinet 11 of the gaming device 10; and (c) one or more suitable electrical or electronic components (not shown) which enable signals to be transmitted between the processor 38 and the input device 20 and which also control and power the game state indicator described below.

The actuation member 100 includes an indicator support structure or indicator support member 104 which supports at least one game state indicator 106. The indicator support member 104 preferably includes a plurality of side walls 108 and an upper contact surface 110. The contact surface 110 is preferably a relatively flat transparent or translucent plastic cover which covers the game state indicator 106; however, the contact surface 110 can be constructed of any suitable shape, color or material. Preferably, the entire support member 104 is molded as a single integral part made of one material, such as a thermoplastic or another suitable plastic.

In addition, the actuator member 100 preferably includes one or more suitable mechanisms (not shown) which enable the actuator member 100 to move between a depressed position and an extended position in response to the player depressing and releasing the actuator member 100. Preferably, the actuator member 100 includes one or more suitable springs or biasing members (not shown) which bias the actuator member 100 to the extended position.

Figure 3:
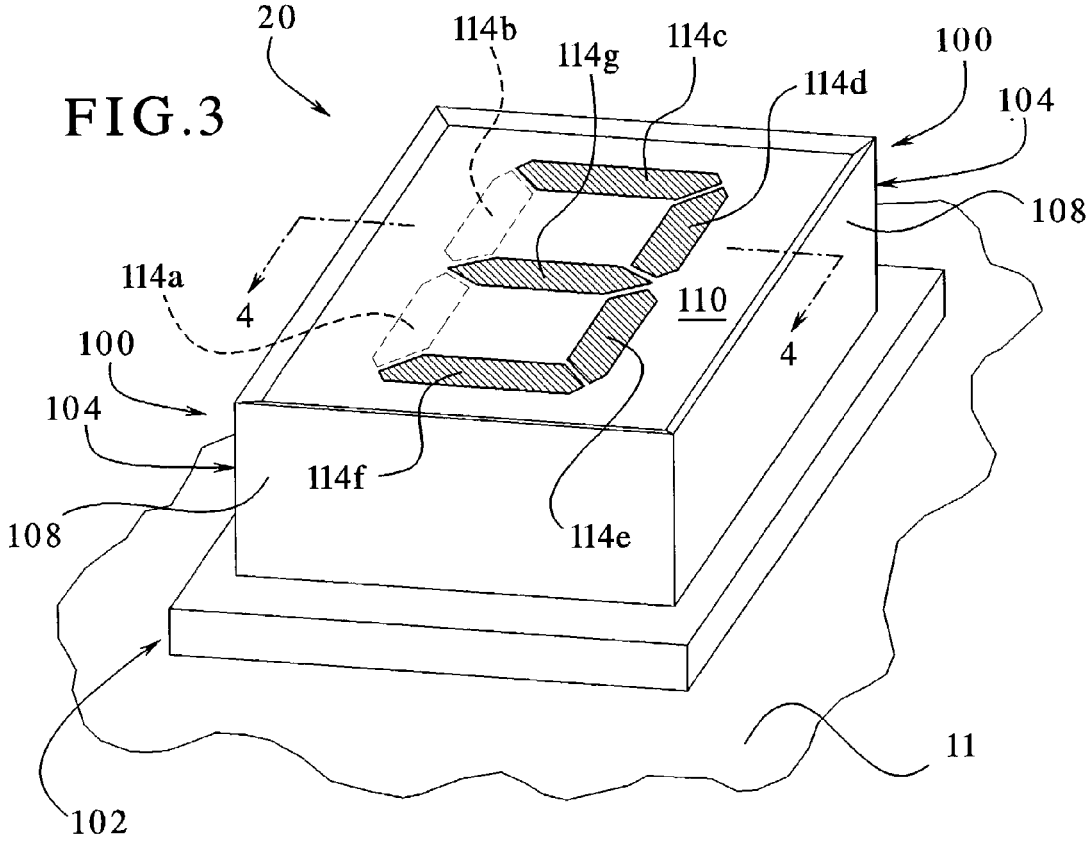
FIG. 3 is an enlarged top perspective view of the input device (removed from a gaming device) illustrating the numeral three formed by a light fixture in one embodiment of the present invention.
Figure 4:
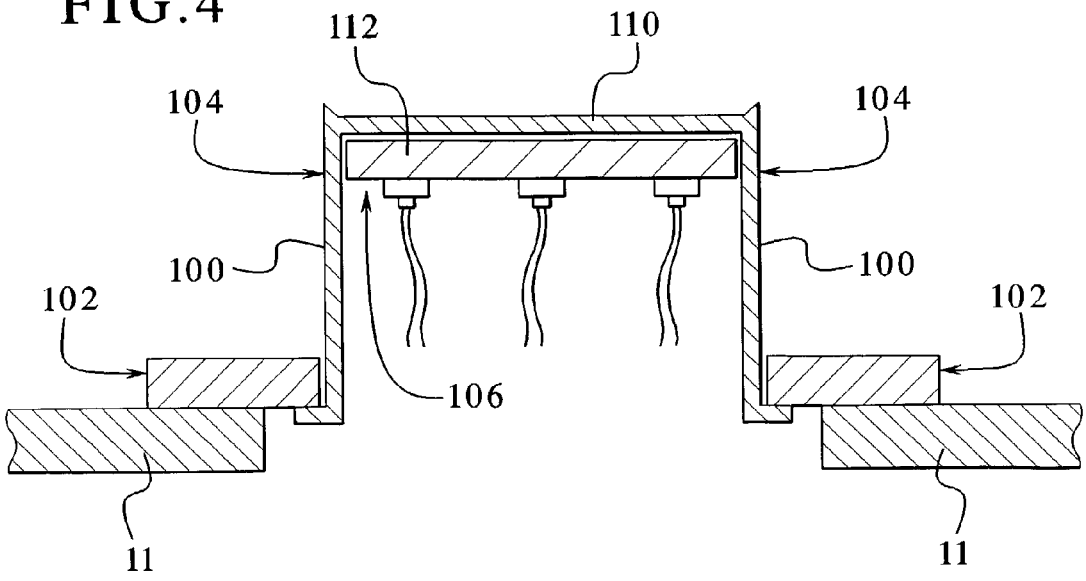
FIG. 4 is a cross-sectional view of the input device (removed from a gaming device) taken substantially along line 4-4 of FIG. 3.

In the embodiment illustrated in FIGS. 3 and 4, the game state indicator 106 includes a light fixture 112 which can display or indicate a plurality of different symbols to a player. It is preferable that the light fixture 112 includes a plurality of LED light sources 114*a* to 114*g*, each of which has an on state and an off state. In the example shown in FIG. 3, the LED lights 114*a* and 114*b* have an off state, and LED lights 114*c* to 114*g* have an on state. This particular combination of on and off LED lights 114*a* to 114*g* forms the numeral three. As controlled by the processor 38, the light fixture 112 can change numerals or other symbols by controlling the on and off states of the different LED lights 114*a* to 114*g*.

Figure 5:
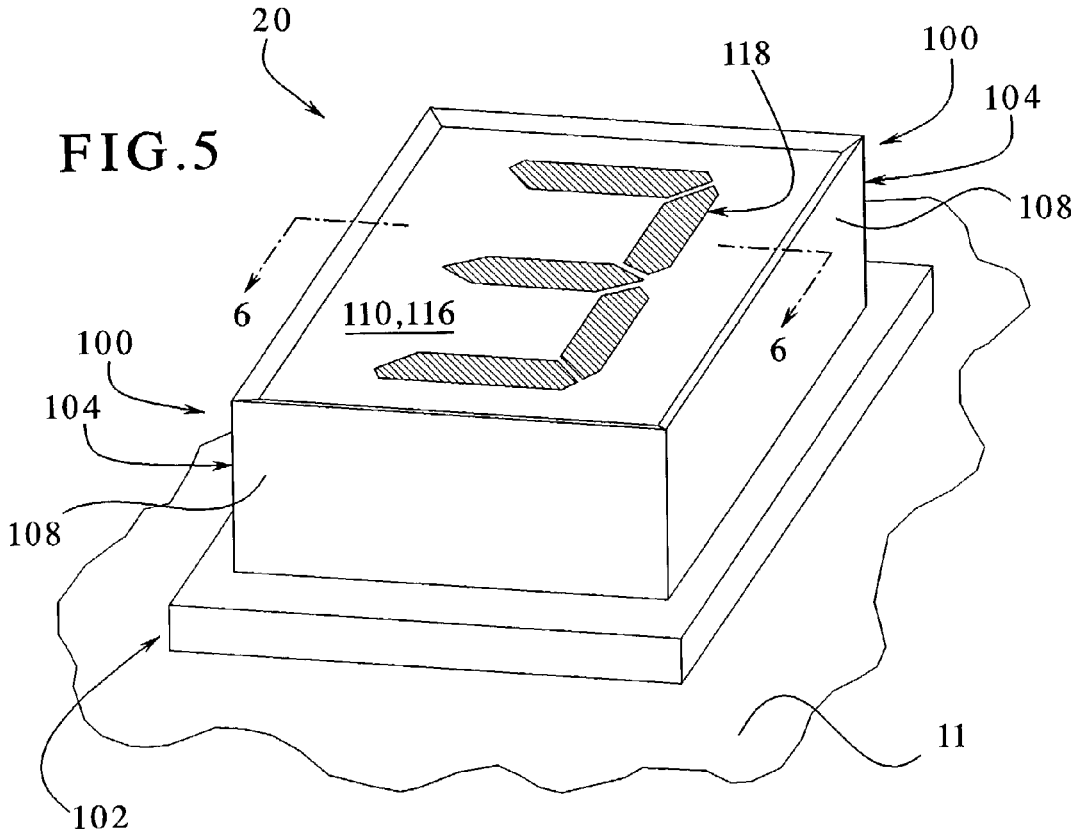
FIG. 5 is an enlarged top perspective view of the input device (removed from a gaming device) illustrating the numeral three formed by a display panel in one embodiment of the present invention.
Figure 6:
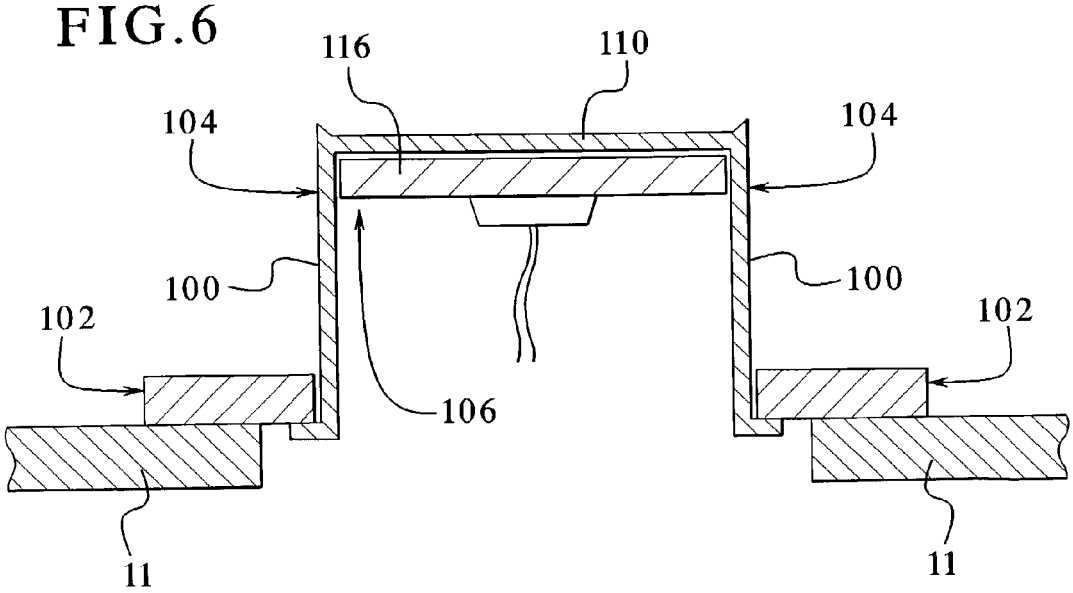
FIG. 6 is a cross-sectional view of the input device (removed from a gaming device) taken substantially along line 6-6 of FIG. 5.

In the embodiment illustrated in FIGS. 5 and 6, the game state indicator 106 includes a suitable display panel 116, preferably a screen, which produces images, such as numeric image 118. The display panel can include any suitable display device capable of producing or generating images, including, but not limited to, a computer screen, an LCD screen, a video screen, a monitor screen or a flat screen. In this example, the processor 38 has caused the display panel 116 to display the numeric image 118 of the numeral three.

Figure 7:
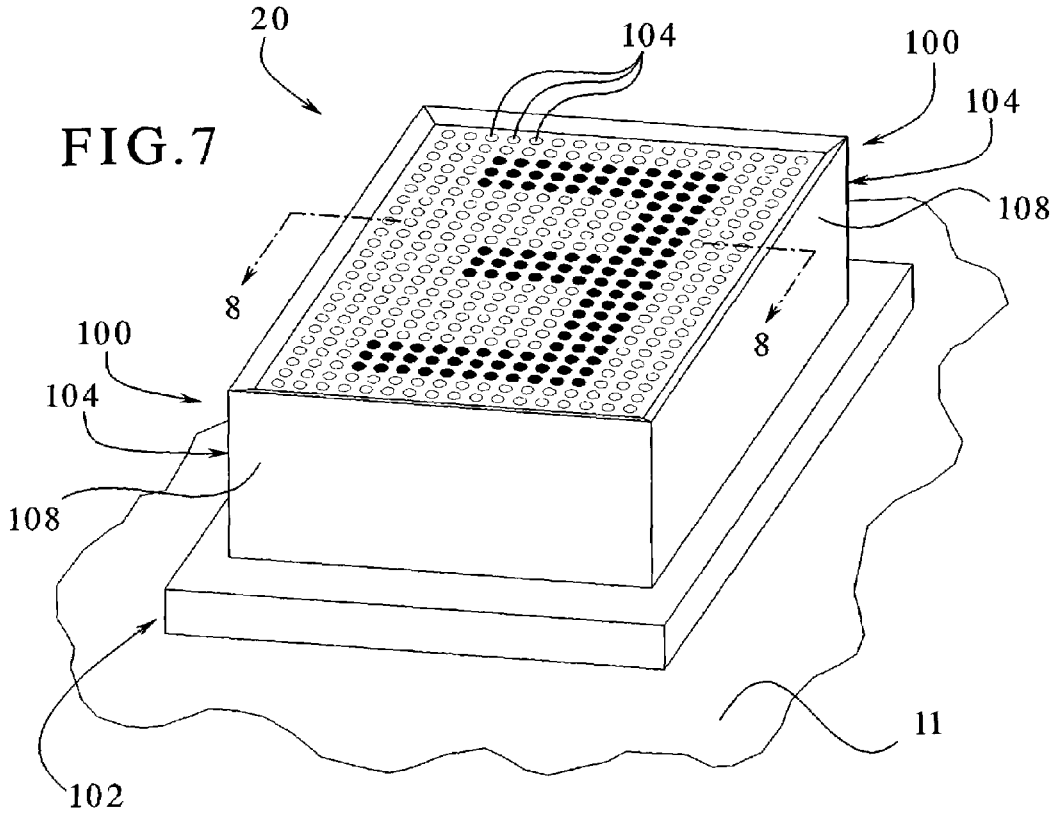
FIG. 7 is an enlarged top perspective view of the input device (removed from a gaming device) illustrating the numeral three formed by an array of light sources in one embodiment of the present invention.
Figure 8:
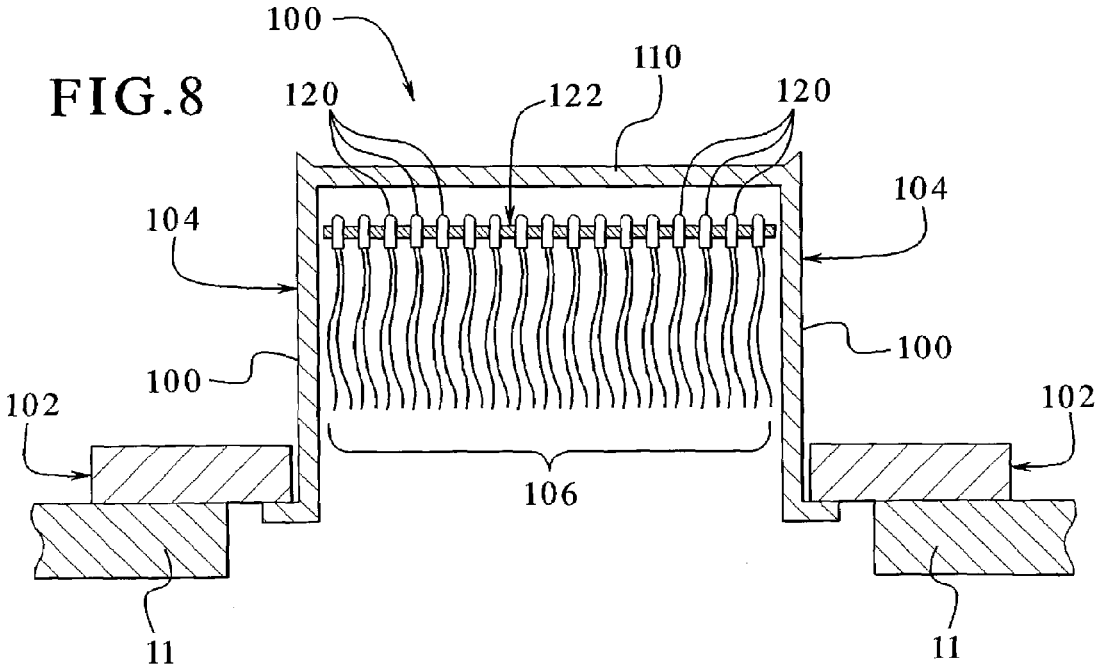
FIG. 8 is a cross-sectional view of the input device (removed from a gaming device) taken substantially along line 6-6 of FIG. 5.

In the embodiment illustrated in FIGS. 7 and 8, the game state indicator includes a plurality of light sources 120, preferably arranged in a matrix, grid or any other suitable array. The actuation member 100 preferably includes a light source template or light source support member 122 which is connected to the inner walls 108 of the indicator support member 104. The light source support member 122 secures the light sources 120 to the actuation member 100 and also maintains the lights sources 120 in a predetermined array. Each light source 120 has an on state and an off state controlled by the gaming device processor 38. In the example shown in FIG. 7, the processor 38 uses the light sources 120 to form symbols, preferably numerals, such as the numeral three.

Figure 9A:
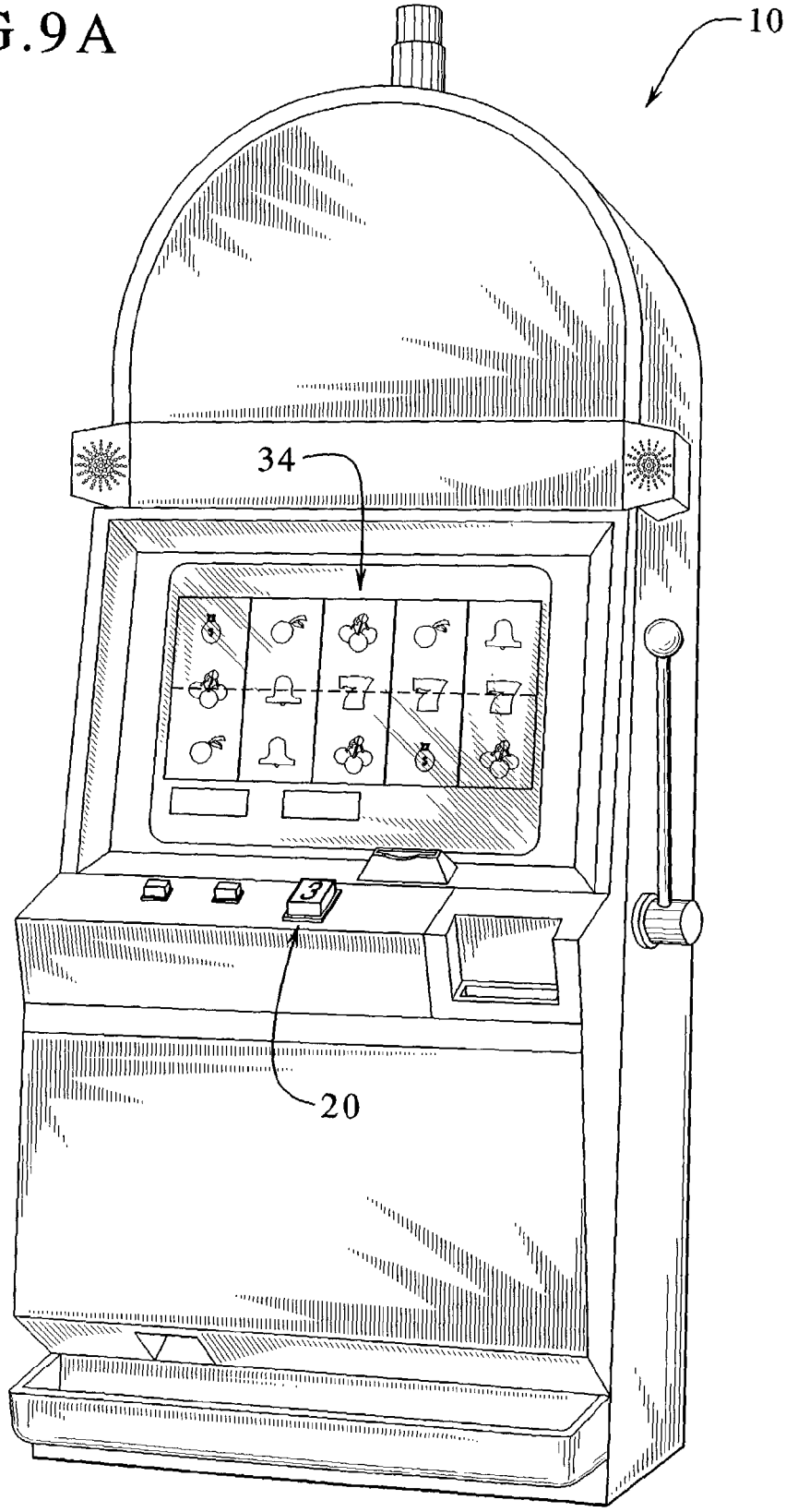
FIGS. 9A to 9D illustrate an example of a player using the input device to make three successive play activations in one embodiment of the present invention.
Figure 9B:
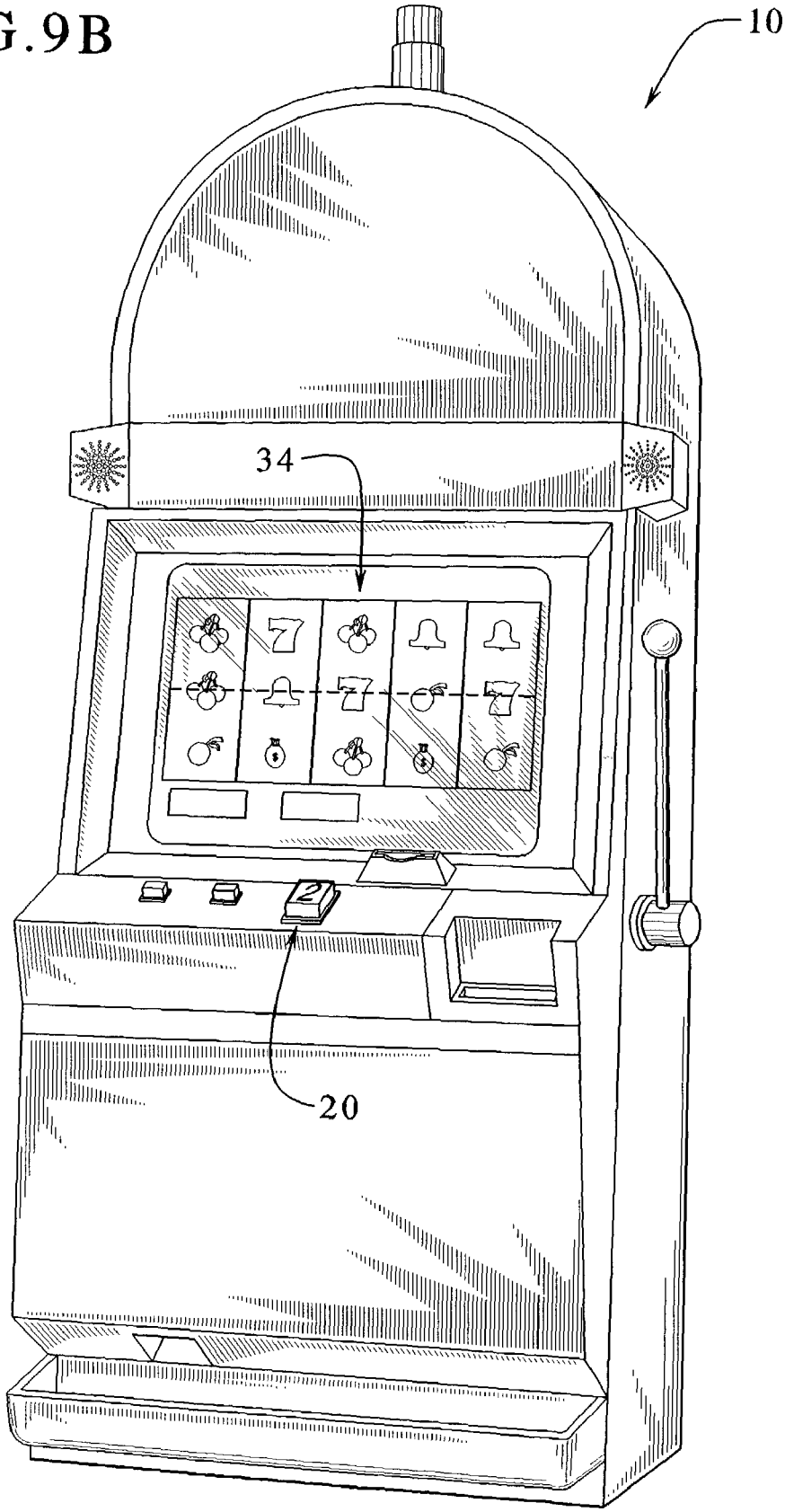
Figure 9C:
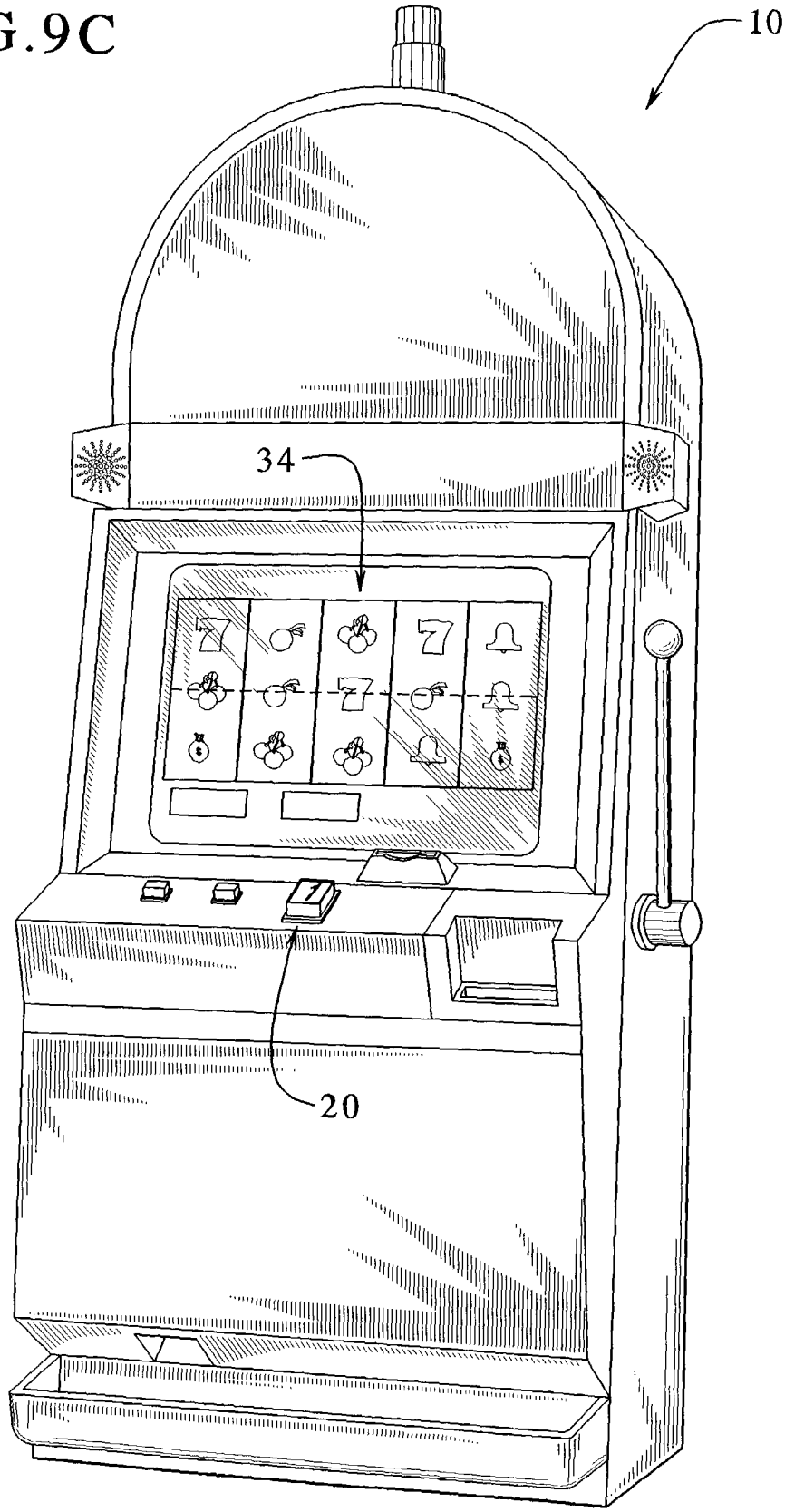
Figure 9D:
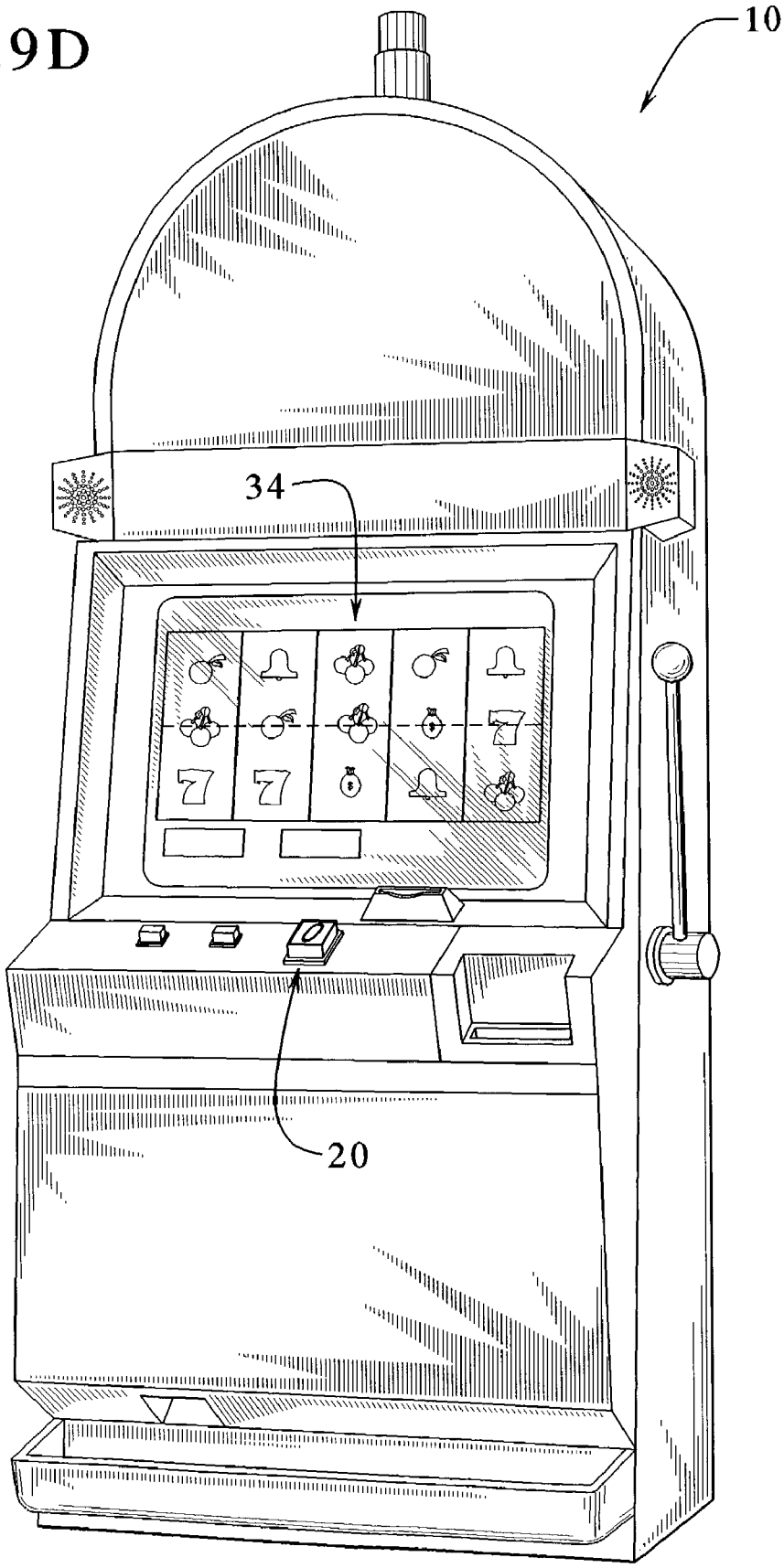

In one embodiment, the game state information which the game state indicator provides to the player, is a quantity of inputs available using input device 20. Preferably, the game state indicator forms a numeral which represents the quantity of play activations available to the player at any point during the game. Referring to FIGS. 9A to 9D, in one example operation of this embodiment, when the player initiates a game using gaming device 10, the gaming device processor 38 may provide the player with three chances to reach a winning combination of symbols on the reels 34. In such case, the input device 20, functioning as a play activator, may initially display the numeral three to the player as illustrated in FIG. 9A. After the player activates the input device 20 in his/her first attempt, the input device 20 displays the numeral two as illustrated in FIG. 9B. After the player activates the input device 20 in his/her second attempt, the input device 20 displays the numeral one as illustrated in FIG. 9C. Finally, after the player activates the input device 20 in his/her third attempt, the input device 20 displays the numeral zero as illustrated in FIG. 9D.

In another embodiment illustrated in FIGS. 10A to 10E, the game state indicator includes a plurality of light sources 122*a* to 122*d* arranged in a grid or matrix. The light sources 122*a* to 122*d* are preferably suitable LED light sources. Each of the light sources 122*a* to 122*d* has an on state and an off state. The game state indicator indicates game state quantities to the player by controlling the on and off states of the light sources 122*a* to 122*d*. Preferably, at any point during a game, the total number of illuminated light sources 122*a* indicates a particular type of game state quantity to the player.

Figure 10A:
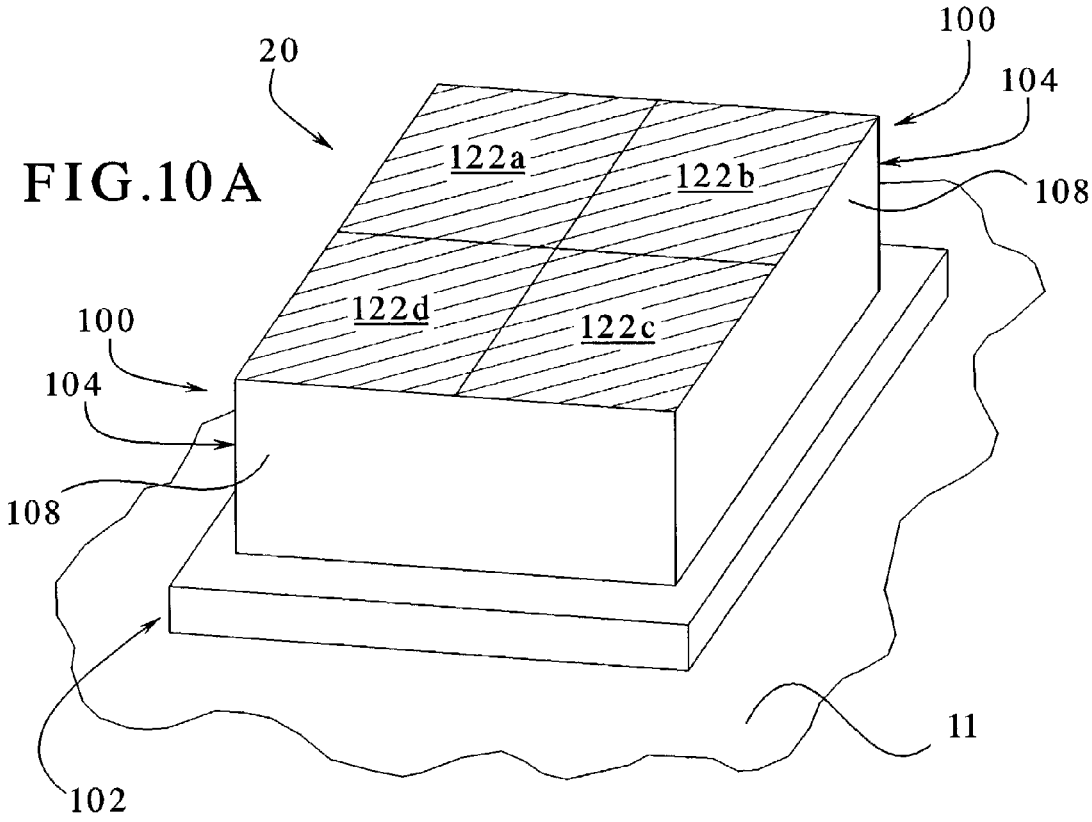
FIGS. 10A to 10E illustrate an example of a player using the input device to make four successive play activations in one embodiment of the present invention.
Figure 10B:
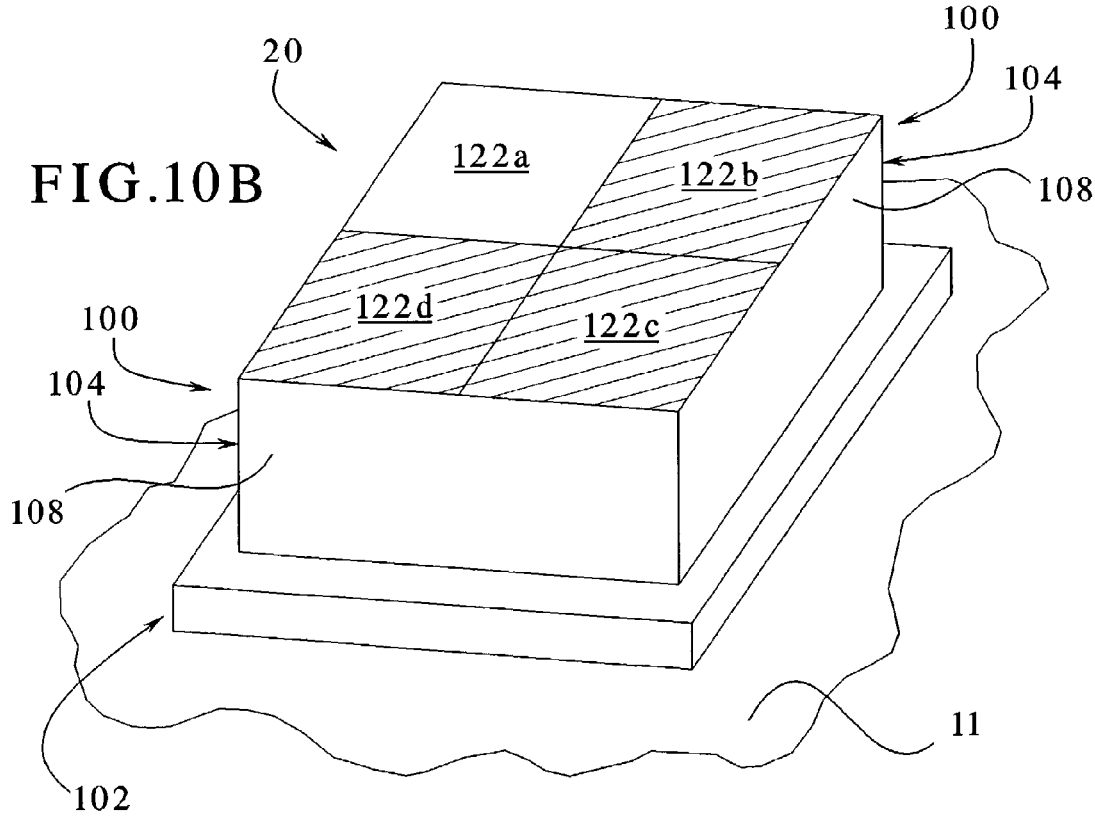
Figure 10C:
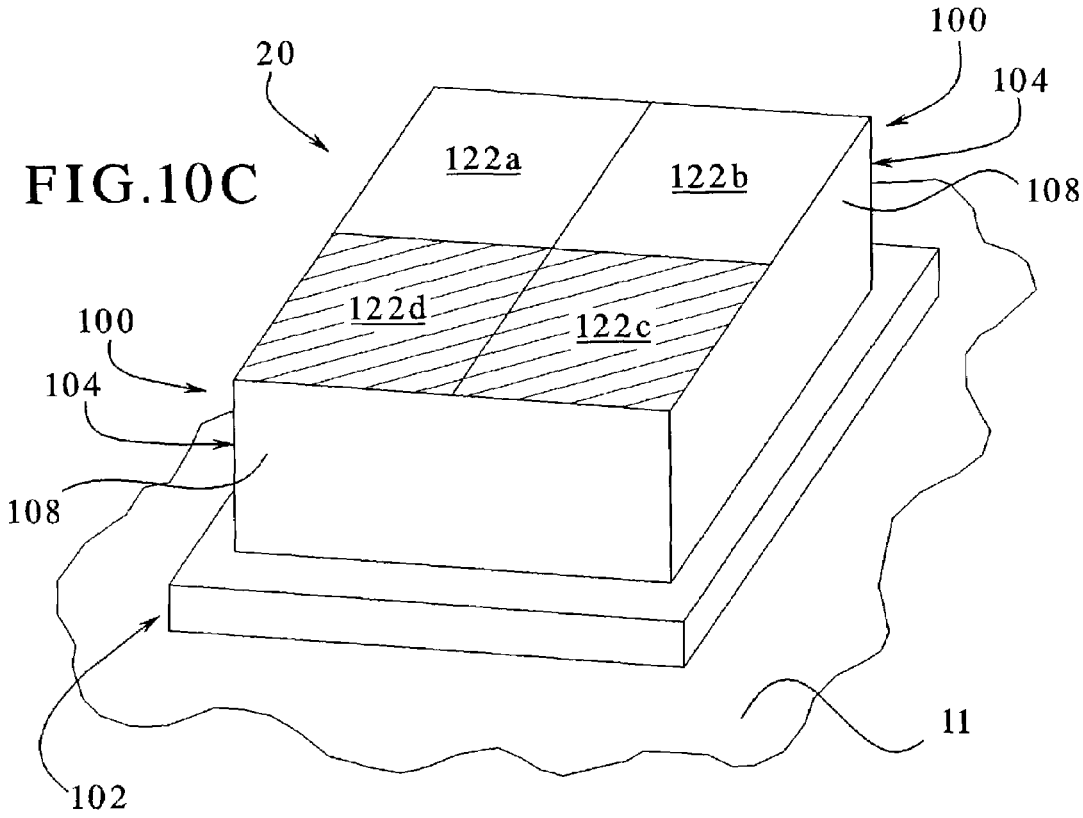
Figure 10D:
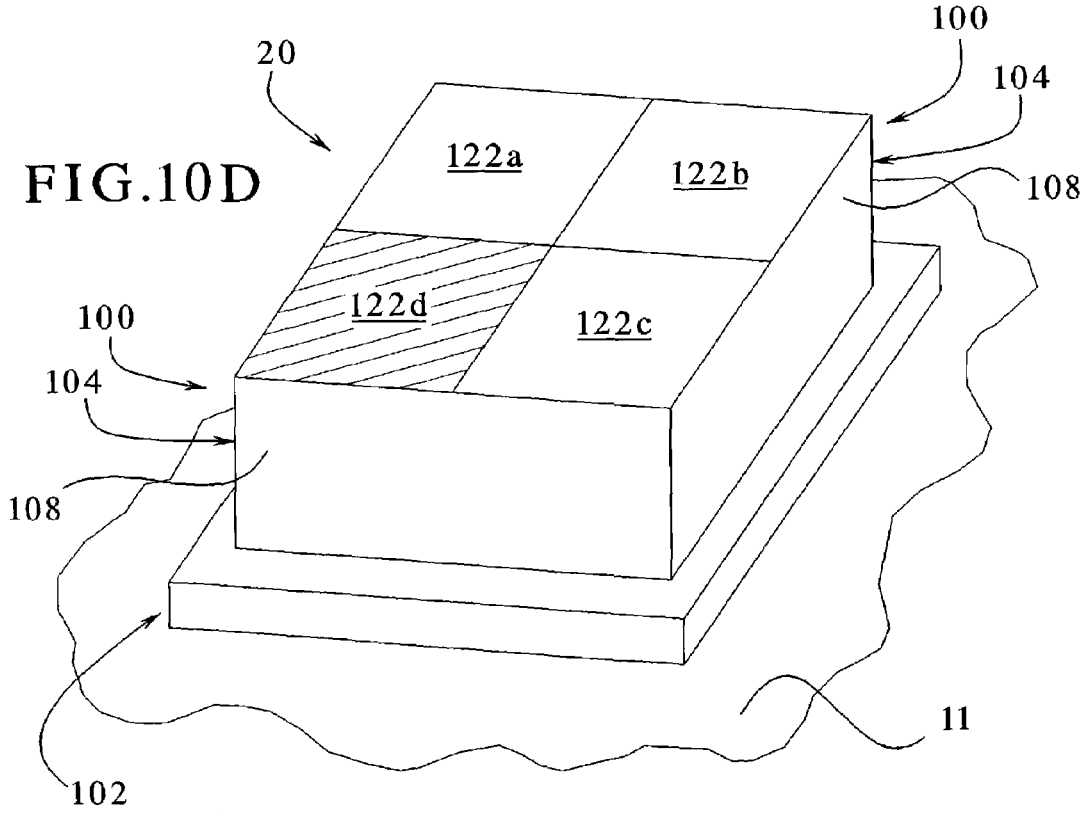
Figure 10E:
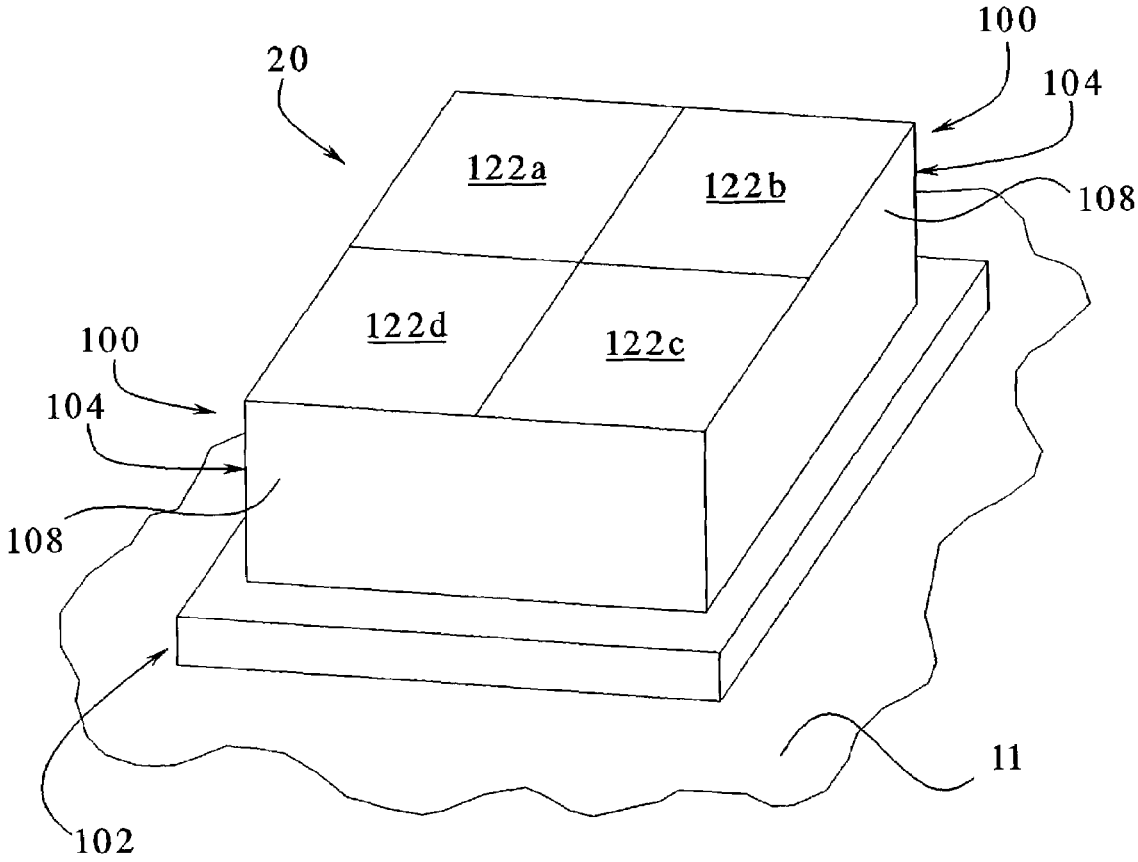

For example, when the player initiates the wager game, the processor may provide the player with four inputs or opportunities to spin the reels in a slot game. Accordingly, the processor 38 may cause the game state indicator to illuminate or turn on all four of the light sources 122*a* to 122*d*, as illustrated in FIG. 10A. For purposes of this example, illuminated light sources are indicated by shaded rectangles, and non-illuminated light sources are indicated by non-shaded rectangles. After the player makes his/her first input by depressing the input device 20, the processor 38 turns off the light source 122*a*, as illustrated in FIG. 10B. Following the second input made by the player, the processor 38 turns off a second light source 122*b*, as illustrated in FIG. 10C. Likewise, following the third input which the player makes, the processor 38 turns off a third light source 122*c*, as illustrated in FIG. 10D. At this point, the player only has one remaining input, and the input device 20 indicates this fact by illuminating only one of the light sources, specifically light source 122*d*. After the player makes a fourth input, the processor 38 turns off the fourth light source 122*d*, and the player has no more inputs as indicated by the non-illuminated light sources 122*a* to 122*d* shown in FIG. 10E In one embodiment, a suitable data storage device, such as the memory device 40, stores game state data associated with a parameter, status, setting or any other characteristic of the gaming device 10 or the wager game of the gaming device 10. The processor 38 uses a suitable program to communicate with such data storage device, read the game state data and cause the input device 20 to indicate a certain symbol, such as a quantity symbol, to the player.

Although the processor 38 is described herein as the processor which controls the input device 20, it should be appreciated that the present invention can include a different processor which directly communicates with and controls the input device 20. A processor of this type, such as an input device processor, would communicate with both the input device 20 and the gaming device processor 38.

It should be understood that the game state data is variable data which changes during play of the gaming device. For example, in one embodiment, each time the player makes a play input, the processor 38 updates the game state data to reflect a decrease in one available play input. Using the up-to-date game state data, the processor 38 causes the game state indicator to form a numeral which represents the current quantity of available play inputs at any one point in time during the game.

It should be appreciated that the illustrations herein of the input device 20 are merely examples and that the input device (including the game state indicator 106) can have any suitable configuration, shape or construction. For example, the indicator support member 104 of the input device 20 can be round, and the contact surface 110 can be dome-shaped. In another example, the light sources can be exposed or protrude at the contact surface 110 or at other surfaces of the input device 20.

It should be appreciated that the input device 20 of the present invention can have general configurations other than that illustrated in FIGS. 1A to 10E. Preferably, the input device is movable between a plurality of positions relative to the gaming device cabinet. For instance, the mechanical input device 20 can have the configuration of a rotatable knob, a toggle switch, a lever, pull-arm or any other suitable mechanical device which enables a player to make an input into the gaming device 10. The game state indicator is suitably housed within such a mechanical device so that one or more surfaces of the mechanical device, when viewed by the player, indicates game state information to the player.

In another embodiment, the input device 20 of the present invention can be used to label input devices, such as various gaming device buttons. For example, the processor 38 can label a button as a cash-out button or a bet button by displaying predetermined text, symbols or images on the input device 20.

In another embodiment of the present invention, when a player is not playing the gaming device and the gaming device is in attract mode, the processor 38 can cause predetermined illuminations, lighting effects or imagery to be displayed by one or more of the input devices 20. For example, predetermined lights in the input devices 20 can blink, change colors, flash or illuminate in a predetermined pattern, sequence or formation. The processor 38 can use these predetermined illuminations to draw attention or to create words, text, messages, symbols or graphics. These input devices 20 can display text messages, images of symbols, characters or other images to provide information and/or entertainment to the player.

It should also be appreciated that the game state indicator in the input device 20 of the present invention can indicate increases in available inputs as well as decreases in available inputs. For example, if the gaming device enables the player to gain inputs during a game by making additional deposits of currency or by making certain achievements while playing a game, the game state indicator can indicate increases in available inputs, for example, from two to four.

The gaming device of the present invention includes an input device having a game state indicator which indicates game state information to the player. In one embodiment, this input device is a play input device which indicates the quantity of inputs which are available to the player at any point in time. The play input device is preferably movable between a plurality of positions relative to the gaming device cabinet. The play input device includes a game state indicator which the gaming device processor causes to form numerals. The numerals represent the quantity of available activations or attempts. At any point in time, the player can learn how many play attempts remain by viewing the game state indicator on the input device. This type of gaming device assists players in the play of their games and also increases the excitement and pleasure they experience when playing gaming devices.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

a cabinet having a first cabinet portion and a second cabinet portion positioned below the first cabinet portion;

a processor configured to be operatively coupled to a server, the server being located remote from the cabinet;

a game display device mounted to the first cabinet portion;

a set of input devices mounted to the second cabinet portion, the set of input devices being positioned below the game display device, each one of said input devices having a depressible portion movable between a plurality of different positions relative to the second cabinet portion;

an additional input device mounted to the second cabinet portion, the additional input device being positioned below the game display device, the additional input device having:

(a) a depressible portion movable, relative to the second cabinet portion, between an extended position and at least one depressed position; and (b) a display device other than the game display device; and a memory device which stores a plurality of instructions, which when executed by the processor, cause the processor to operate with the game display device, the set of input devices, and the additional input device to:

(a) activate an attract mode before any wagering games are activated, the wagering games including a first type of wagering game and a second type of wagering game;

(b) during the attract mode, cause the display device of the additional input device to produce at least one visual output;

(c) receive a signal from the server before or after the attract mode is activated, the signal being associated with one of:

(i) the first type of wagering game, the first type of wagering game having a plurality of first game symbols, a plurality of first game rules, and a first game pay table, and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) end the attract mode and activate the first type of wagering game without activating the second type of wagering game;

(ii) cause the game display device to display the first game symbols;

(iii) cause the display device of the additional input device to visually indicate first information related to a first play option of the first type of wagering game;

(iv) receive a plurality of input signals including:

(x) at least one input signal resulting from an activation of at least one of the input devices of the set of input devices; and (y) at least one other input signal resulting from an activation of the additional input device;

(v) operate the first type of wagering game based, at least in part, on said received input signals in accordance with the first game rules; and (vi) indicate an outcome based on the operation of the first type of wagering game in accordance with the first game pay table; and (e) if the input signal is associated with the second type of wagering game:

(i) end the attract mode and activate the second type of wagering game without activating the first type of wagering game;

(ii) cause the game display device to display the second game symbols;

(iii) cause the display device of the additional input device to visually indicate second information related to a second play option of the second type of wagering game, said second play option being different from the first play option of the first type of wagering game, said second information being different from the first information;

(iv) receive a plurality of input signals including:

(x) at least one input signal resulting from an activation of at least one of the input devices of the set of input devices; and (y) at least one other input signal resulting from an activation of the additional input device;

(v) operate the second type of wagering game based, at least in part, on said received input signals in accordance with the second game rules; and (vi) indicate an outcome based on the operation of the second type of wagering game in accordance with the second game pay table.

2. The gaming device of claim 1, wherein the signal received from the server includes data selected from the group consisting of event data, game state data, game state quantities, input availability data, data associated with a game variable, data associated with a game parameter, data associated with a game characteristic, data associated with a quantity of available inputs, data associated with a quantity of bets placed, data associated with a quantity of remaining credits, data associated with a payline specification, data associated with a game rule and data associated with a pay table.

3. The gaming device of claim 1, wherein the first type of wagering game includes a primary game.

4. The gaming device of claim 1, wherein the second type of wagering game includes a secondary game triggered after a primary game begins.

5. A gaming device comprising:

a cabinet having a first cabinet portion and a second cabinet portion positioned below the first cabinet portion;

a processor configured to be operatively coupled to a server over a data network, the server being located remote from the cabinet;

a game display device mounted to the first cabinet portion;

a set of input devices mounted to the second cabinet portion, the set of input devices being positioned below the game display device, each one of said input devices having a depressible portion movable between a plurality of different positions relative to the second cabinet portion;

an additional input device mounted to the second cabinet portion, the additional input device being positioned below the game display device, the additional input device having:

(a) a depressible portion movable, relative to the second cabinet portion, between an extended position and at least one depressed position; and (b) a display device other than the game display device; and a memory device which stores a plurality of instructions, which when executed by the processor, cause the processor to operate with the game display device, the set of input devices, and the additional input device to:

(a) activate an attract mode before any wagering games are activated, the wagering games including a first type of wagering game and a second type of wagering game;

(b) during the attract mode, cause the display device of the additional input device to produce at least one visual output;

(c) receive a signal from the server before or after the attract mode is activated, the signal being associated with one of:

(i) the first type of wagering game, the first type of wagering game having a plurality of first game symbols, a plurality of first game rules, and a first game pay table; and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) end the attract mode and activate the first type of wagering game without activating the second type of wagering game;

(ii) cause the game display device to display the first game symbols;

(iii) cause the display device of the additional input device to visually indicate first information related to a first play option of the first type of wagering game;

(iv) receive a plurality of input signals including:

(x) at least one input signal resulting from an activation of at least one of the input devices of the set of input devices; and (y) at least one other input signal resulting from an activation of the additional input device;

(v) operate the first type of wagering game based, at least in part, on said received input signals in accordance with the first game rules; and (vi) indicate an outcome based on the operation of the first type of wagering game in accordance with the first game pay table; and (e) if the input signal is associated with the second type of wagering game:

(i) end the attract mode and activate the second type of wagering game without activating the first type of wagering game;

(ii) cause the game display device to display the second game symbols;

(iii) cause the display device of the additional input device to visually indicate second information related to a second play option of the second type of wagering game, said second play option being different from the second play option of the first type of wagering game, said second information being different from the first information;

(iv) receive a plurality of input signals including:

(x) at least one input signal resulting from an activation of at least one of the input devices of the set of input devices; and (y) at least one other input signal resulting from an activation of the additional input device;

(v) operate the second type of wagering game based, at least in part, on said received input signals in accordance with the second game rules; and (vi) indicate an outcome based on the operation of the second type of wagering game in accordance with the second game pay table.

6. The gaming device of claim 5, wherein one of the first and second types of wagering games includes a primary game, and a different one of the first and second types of wagering games includes a secondary game.

7. The gaming device of claim 5, wherein at least one of the first and second types of wagering games includes a game selected from the group consisting of a slot game, a blackjack game, a poker game and a keno game.

8. The gaming device of claim 5, wherein the display device of the additional input device includes at least one light source.

9. The gaming device of claim 5, wherein the display device of the additional input device includes an array of light sources.

10. The gaming device of claim 5, wherein the display device of the additional input device includes a plurality of light sources.

11. The gaming device of claim 10, wherein the light sources are positioned relative to each other so as to form at least one symbol.

12. The gaming device of claim 10, wherein each of the light sources has an on state and an off state.

13. The gaming device of claim 12, wherein each of the light sources which has an on state representing a single quantity of activations.

14. The gaming device of claim 5, wherein the display device of the additional input device includes at least one display panel.

15. The gaming device of claim 14, wherein the display panel includes at least one screen.

16. The gaming device of claim 15, wherein the screen is selected from the group consisting of an LCD screen, a video screen and a monitor screen.

17. A gaming device comprising:

a cabinet having a first cabinet portion and a second cabinet portion positioned below the first cabinet portion;

a processor configured to be operatively coupled to a server over a data network, the server being located remote from the cabinet;

a game display device mounted to the first cabinet portion; and a set of input devices mounted to the second cabinet portion, the set of input devices being positioned below the game display device, each one of said input devices having a depressible portion movable between a plurality of different positions relative to the second cabinet portion;

an additional input device mounted to the second cabinet portion, the additional input device being positioned below the game display device, the additional input device having:

(a) a depressible portion movable, relative to the second cabinet portion, between an extended position and at least one depressed position, and (b) a display device other than the game display device; and a memory device which stores a plurality of instructions, which when executed by the processor, cause the processor to operate with the game display device, the set of input devices, and the additional input device to:

(a) activate an attract mode before any wagering games are activated, the wagering games including a first type of wagering game and a second type of wagering game;

(b) during the attract mode, cause the display device of the additional input device to produce at least one visual output;

(c) receive a signal from the server before or after the attract mode is activated, the signal being associated with one of: (i) the first type of wagering game, the first type of wagering game having a plurality of first game symbols, a plurality of first game rules, and a first game pay table; and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) end the attract mode and activate the first type of wagering game without activating the second type of wagering game;

(ii) cause the game display device to display the first game symbols;

(iii) cause the display device of the additional input device to visually indicate first information related to a first play option of the first type of wagering game;

(iv) receive a plurality of input signals including:

(x) at least one input signal resulting from an activation of at least one of the input devices of the set of input devices; and (y) at least one other input signal resulting from an activation of the additional input device;

(v) operate the first type of wagering game based, at least in part, on said received input signals in accordance with the first game rules; and (vi) indicate an outcome based on the operation of the first type of wagering game in accordance with the first game pay table;

(e) if the input signal is associated with the second type of wagering game:

(i) end the attract mode and activate the second type of wagering game without activating the first type of wagering game;

(ii) cause the game display device to display the second game symbols;

(iii) cause the display device of the additional input device to visually indicate second information related to a second play option of the second type of wagering game, said second play option being different from the first play option of the first type of wagering game, said second information being different from the first information;

(iv) receive a plurality of input signals including:

(x) at least one input signal resulting from an activation of at least one of the input devices of the set of input devices; and (y) at least one other input signal resulting from an activation of the additional input device;

(v) operate the second type of wagering game based, at least in part, on said received input signals in accordance with the second game rules; and (vi) indicate an outcome based on the operation of the second type of wagering game in accordance with the second game pay table.

18. The gaming device of claim 17, wherein the display device of the additional input device includes at least one light source.

19. The gaming device of claim 17, wherein the display device of the additional input device includes a plurality of light sources.

20. The gaming device of claim 19, wherein the light sources are positioned relative to each other to form the symbol.

21. The gaming device of claim 17, wherein the display device of the additional input device includes an array of light sources.

22. The gaming device of claim 17, wherein the display device of the additional input device includes at least one display panel.

23. The gaming device of claim 22, wherein the display panel includes at least one screen.

24. The gaming device of claim 23, wherein the screen is selected from the group consisting of an LCD screen, a video screen and a monitor screen.

25. The gaming device of claim 17, wherein one of the first and second types of wagering games includes a primary game, and a different one of the first and second types of wagering games includes a secondary game.

26. The gaming device of claim 25, wherein at least one of the first and second types of wagering games includes a game selected from the group consisting of a slot game, a blackjack game, a poker game and a keno game.

27. The method of claim 17, which includes the step of causing a screen of the display device of the additional input device to display at least one symbol describing a wager action associated with one of the games.

28. A gaming device comprising:

a cabinet having a first cabinet portion and a second cabinet portion positioned below the first cabinet portion;

a processor configured to be operatively coupled to a server over a data network, the server being located remote from the cabinet;

a game display device mounted to the first cabinet portion;

a set of input devices mounted to the second cabinet portion, the set of input devices being positioned below the game display device, each one of said input devices having a depressible portion movable between a plurality of different positions relative to the second cabinet portion;

an additional input device mounted to the second cabinet portion, the additional input device being positioned below the game display device, the additional input device having:

(a) a depressible portion movable, relative to the second cabinet portion, between an extended position and at least one depressed position; and (b) a display device other than the game display device; and a memory device which stores a plurality of instructions, which when executed by the processor, cause the processor to operate with the game display device, the set of input devices, and the additional input device to:

(a) activate an attract mode before any wagering games are activated, the wagering games including a first type of wagering game and a second type of wagering game;

(b) during the attract mode, cause the display device of the additional input device to produce at least one visual output;

(c) receive a signal from the server, the signal being associated with one of: (i) the first type of wagering game, the first type of wagering game having a plurality of first game symbols, a plurality of first game rules, and a first game pay table; and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) end the attract mode and activate the first type of wagering game without activating the second type of wagering game;

(ii) cause the game display device to display the first game symbols;

(iii) cause the display device of the additional input device to visually indicate first information related to a first play option of the first type of wagering game;

(iv) receive a plurality of input signals including:

(x) at least one input signal resulting from an activation of at least one of the input devices of the set of input devices; and (y) at least one other input signal resulting from an activation of the additional input device;

(v) operate the first type of wagering game based, at least in part, on said received input signals in accordance with the first game rules; and (vi) indicate an outcome based on the operation of the first type of wagering game in accordance with the first game pay table;

(e) if the input signal is associated with the second type of wagering game:

(i) end the attract mode and activate the second type of wagering game without activating the first type of wagering game;

(ii) cause the game display device to display the second game symbols;

(iii) cause the display device of the additional input device to visually indicate second information related to a second play option of the second type of wagering game, said second play option being different from the first play option of the first type of wagering game, said second information being different from the first information;

(iv) receive a plurality of input signals including:

(x) at least one input signal resulting from an activation of at least one of the input devices of the set of input devices; and (y) at least one other input signal resulting from an activation of the additional input device;

(v) operate the second type of wagering game based, at least in part, on said received input signals in accordance with the second game rules; and (vi) indicate an outcome based on the operation of the second type of wagering game in accordance with the second game pay table.

29. The gaming device of claim 28, wherein one of the first and second types of wagering games includes a primary game, and a different one of the first and second types of wagering games includes a secondary game.

30. The gaming device of claim 28, wherein at least one of the first and second types of wagering games includes a game selected from the group consisting of a slot game, a blackjack game, a poker game and a keno game.

31. The gaming device of claim 28, wherein the display device of the additional input device includes at least one light source.

32. The gaming device of claim 28, wherein the display device of the additional input device includes a plurality of light sources.

33. The gaming device of claim 28, wherein the display device of the additional input device includes at least one display panel.

34. The gaming device of claim 33, wherein the display panel includes at least one screen.

35. The gaming device of claim 34, wherein the screen is selected from the group consisting of an LCD screen, a video screen and a monitor screen.

36. A method for manufacturing a gaming device, the method comprising:

configuring a processor to be operatively coupled to a server, the processor being supported by a cabinet, the server being located remote from the cabinet;

mounting a game display device to a first cabinet portion of the cabinet;

mounting a set of input devices to a second cabinet portion of the cabinet, the set of input devices being positioned below the game display device, each one of said input devices having a depressible portion movable between a plurality of different positions relative to the second cabinet portion;

mounting an additional input device to the second cabinet portion, the additional input device being positioned below the game display device, wherein the additional input device has:

(a) a depressible portion movable, relative to the second cabinet portion, between an extended position and at least one depressed position; and (b) a display device other than the game display device; and configuring the processor to execute a plurality of instructions to operate with the game display device, the set of input devices, and the additional input device to:

(a) activate an attract mode before any wagering games are activated, the wagering games including a first type of wagering game and a second type of wagering game;

(b) during the attract mode, cause the display device of the additional input device to produce at least one visual output;

(c) receive a signal from the server, the signal being associated with one of: (i) the first type of wagering game, the first type of wagering game having a plurality of first game symbols, a plurality of first game rules, and a first game pay table; and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) end the attract mode and activate the first type of wagering game without activating the second type of wagering game;

(ii) cause the game display device to display the first game symbols;

(iii) cause the display device of the additional input device to visually indicate first information related to a first play option of the first type of wagering game;

(iv) receive a plurality of input signals including:

(x) at least one input signal resulting from an activation of at least one of the input devices of the set of input devices; and (y) at least one other input signal resulting from an activation of the additional input device;

(v) operate the first type of wagering game based, at least in part, on said received input signals in accordance with the first game rules; and (vi) indicate an outcome based on the operation of the first type of wagering game in accordance with the first game pay table;

(e) if the input signal is associated with the second type of wagering game:

(i) end the attract mode and activate the second type of wagering game without activating the first type of wagering game;

(ii) cause the game display device to display the second game symbols;

(iii) cause the display device of the additional input device to visually indicate second information related to a second play option of the second type of wagering game, said second play option being different from the first play option of the first type of wagering game, said second information being different from the first information;

(iv) receive a plurality of input signals including:

(x) at least one input signal resulting from an activation of at least one of the input devices of the set of input devices; and (y) at least one other input signal resulting from an activation of the additional input device;

(v) operate the second type of wagering game based, at least in part, on said received input signals in accordance with the second game rules; and (vi) indicate an outcome based on the operation of the second type of wagering game in accordance with the second game pay table.

37. The method of claim 36, which includes the step of causing at least one light source of the display device of the additional input device to display at least one symbol describing a wager action associated with one of the games.

38. The method of claim 36, which includes the step of causing a plurality of light sources of the display device of the additional input device to display at least one symbol describing a wager action associated with one of the games.

39. The method of claim 36, wherein one of the first and second types of wagering games includes a primary game, and a different one of the first and second types of wagering games includes a secondary game.

40. The method of claim 36, wherein at least one of the first and second types of wagering games includes a game selected from the group consisting of a slot game, a blackjack game, a poker game and a keno game.

41. A gaming device comprising:

a cabinet having a first cabinet portion and a second cabinet portion positioned below the first cabinet portion;

a game display device mounted to the first cabinet portion;

a set of buttons mounted to the second cabinet portion, the set of buttons being positioned below the game display device, each one of said buttons having a depressible portion movable between a plurality of different positions relative to the second cabinet portion;

an additional button mounted to the second cabinet portion, the additional button being positioned below the game display device, the additional button having:

(a) a depressible portion which is movable, relative to the second cabinet portion, between an extended position and at least one depressible position;

(b) a spring which biases the depressible portion toward the extended position; and (c) a display device other than the game display device, the display device of the additional button having a screen;

a processor configured to be operatively coupled to a server, the server being located remote from the cabinet; and a memory device which stores a plurality of instructions, which, when executed by the processor, cause the processor to operate with the game display device, the set of buttons, and the additional button to:

(a) activate an attract mode before any wagering games are activated, the wagering games including a first type of wagering game and a second type of wagering game;

(b) during the attract mode, cause the display device of the additional button to produce at least one visual output;

(c) receive a signal from the server, the signal being associated with one of: (i) the first type of wagering game, the first type of wagering game having a plurality of first game symbols, a plurality of first game rules, and a first game pay table; and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) activate the first type of wagering game without activating the second type of wagering game;

(ii) cause the game display device to display the first game symbols;

(iii) cause the display device of the additional button to visually indicate first information related to a first play option of the first type of wagering game, the visually indicated first information functioning as a label for the additional button;

(iv) receive a plurality of input signals including:

(x) at least one input signal resulting from an activation of at least one of the buttons of the set of buttons; and (y) at least one other input signal resulting from an activation of the additional button;

(v) operate the first type of wagering game based, at least in part, on said received input signals in accordance with the first game rules; and (vi) indicate an outcome based on the operation of the first type of wagering game in accordance with the first game pay table;

(e) if the input signal is associated with the second type of wagering game:

(i) activate the second type of wagering game without activating the first type of wagering game;

(ii) cause the game display device to display the second game symbols;

(iii) cause the display device of the additional button to visually indicate second information related to a second play option of the second type of wagering game, the visually indicated first information functioning as a label for the additional button, said second play option being different from the first play option of the first type of wagering game, said second information being different from the first information;

(iv) receive a plurality of input signals including:

(x) at least one input signal resulting from an activation of at least one of the buttons of the set of buttons; and (y) at least one other input signal resulting from an activation of the additional button;

(v) operate the second type of wagering game based, at least in part, on said received input signals in accordance with the second game rules; and (vi) indicate an outcome based on the operation of the second type of wagering game in accordance with the second game pay table.

42. The gaming device of claim 41, wherein the signals associated with the first and second types of wagering games are associated with different characteristics, at least one of the characteristics being selected from the group consisting of a quantity of inputs which is available, a type of input which is available, a process of providing an input which is available, and a result of an input which is available.

43. The gaming device of claim 41, wherein one of the first and second types of wagering games includes a primary game, and a different one of the first and second types of wagering games includes a secondary game.

44. The gaming device of claim 43, wherein at least one of the first and second types of wagering games includes a game selected from the group consisting of a slot game, a blackjack game, a poker game and a keno game.

45. The gaming device of claim 41, wherein the display device of the additional button includes a device selected from the group consisting of: (a) a device including at least one light source; (b) a device including a plurality of light sources; (c) a device including an array of light sources; (d) a device including a display panel; and (e) a device including a display panel having a screen.

46. A gaming device operable under control of a processor, said gaming device comprising:

a cabinet having a first cabinet portion and a second cabinet portion positioned below the first cabinet portion;

a primary game display device controlled by the processor, the primary game display device being mounted to the first cabinet portion;

a set of buttons mounted to the second cabinet portion, the set of buttons being positioned below the game display device, each one of said buttons having a depressible portion movable between a plurality of different positions relative to the second cabinet portion;

an additional button mounted to the second cabinet portion, the additional button being positioned below the primary game display device, the additional button having:

(a) a depressible portion which is movable, relative to the second cabinet portion, between an extended position and at least one depressible position;

(b) a spring which biases the depressible portion toward the extended position; and (c) a display device other than the game display device, the display device of the additional button having a screen;

a memory device accessible by a server over a network, the server being located remote from the cabinet, the memory device storing a plurality of instructions, the instructions being executable by the processor to operate with the game display device, the set of buttons, and the additional button to:

(a) activate an attract mode before any wagering games are activated, the wagering games including a first type of wagering game and a second type of wagering game;

(b) during the attract mode, cause the display device of the additional button to produce at least one visual output;

(c) receive a signal from the server, the signal being associated with one of: (i) the first type of wagering game, the first type of wagering game having a plurality of first game symbols, a plurality of first game rules, and a first game pay table; and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) end the attract mode and activate the first type of wagering game without activating the second type of wagering game;

(ii) cause the game display device to display the first game symbols;

(iii) cause the display device of the additional button to visually indicate first information related to a first play option of the first type of wagering game, the visually indicated first information functioning as a label for the additional button;

(iv) receive a plurality of input signals including:

(x) at least one input signal resulting from an activation of at least one of the buttons of the set of buttons; and (y) at least one other input signal resulting from an activation of the additional button;

(v) operate the first type of wagering game based, at least in part, on said received input signals in accordance with the first game rules; and (vi) indicate an outcome based on the operation of the first type of wagering game in accordance with the first game pay table;

(e) if the input signal is associated with the second type of wagering game:

(i) end the attract mode and activate the second type of wagering game without activating the first type of wagering game;

(ii) cause the game display device to display the second game symbols;

(iii) cause the display device of the additional button to visually indicate second information related to a second play option of the second type of wagering game, the visually indicated first information functioning as a label for the additional button, said second play option being different from the first play option of the first type of wagering game, said second information being different from the first information;

(iv) receive a plurality of input signals including:

(x) at least one input signal resulting from an activation of at least one of the buttons of the set of buttons; and (y) at least one other input signal resulting from an activation of the additional button;

(v) operate the second type of wagering game based, at least in part, on said received input signals in accordance with the second game rules; and (vi) indicate an outcome based on the operation of the second type of wagering game in accordance with the second game pay table.

47. The gaming device of claim 46, wherein the first type of wagering game includes a game selected from the group consisting of a slot game, a blackjack game, a poker game and a keno game.

48. The gaming device of claim 47, wherein the second type of wagering game includes a different game selected from the group consisting of a slot game, a blackjack game, a poker game and a keno game.

49. The gaming device of claim 46, wherein the display device of the additional button includes a device selected from the group consisting of: (a) a device including at least one light source; (b) a device including a plurality of light sources; (c) a device including an array of light sources; (d) a device including a display panel; and (e) a device including a display panel having a screen.

50. A gaming device operable under control of a processor, said gaming device comprising:

a cabinet having a first cabinet portion and a second cabinet portion positioned below the first cabinet portion;

a game display device mounted to the first cabinet portion;

a set of buttons mounted to the second cabinet portion, the set of buttons being positioned below the game display device, each one of said buttons having a depressible portion movable between a plurality of different positions relative to the second cabinet portion;

an additional button mounted to the second cabinet portion, the additional button being positioned below the game display device, the additional button having:

(a) a depressible portion which is movable, relative to the second cabinet portion, between an extended position and at least one depressible position;

(b) a spring which biases the depressible portion toward the extended position; and (c) a display device other than the game display device, the display device of the additional button having a screen;

a memory device accessible by a server over a network, the server being located remote from the cabinet, the memory device storing a plurality of instructions, the instructions being executable by the processor to operate with the game display device, the set of buttons, and the additional button to:

(a) activate an attract mode before any wagering games are activated, the wagering games including a first type of wagering game and a second type of wagering game;

(b) during the attract mode, cause the display device of the additional button to produce at least one visual output;

(c) receive a signal from the server, the signal being associated with one of: (i) the first type of wagering game, the first type of wagering game having a plurality of first game symbols, a plurality of first game rules, and a first game pay table; and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) end the attract mode and activate the first type of wagering game without activating the second type of wagering game;

(ii) cause the game display device to display the first game symbols;

(iii) cause the display device of the additional button to visually indicate first information related to a first play option of the first type of wagering game, the visually indicated first information functioning as a label for the additional button;

(iv) receive a plurality of input signals including:

(x) at least one input signal resulting from an activation of at least one of the buttons of the set of buttons; and (y) at least one other input signal resulting from an activation of the additional button;

(v) operate the first type of wagering game based, at least in part, on said received input signals in accordance with the first game rules; and (vi) indicate an outcome based on the operation of the first type of wagering game in accordance with the first game pay table;

(e) if the input signal is associated with the second type of wagering game:

(i) end the attract mode and activate the second type of wagering game without activating the first type of wagering game;

(ii) cause the game display device to display the second game symbols;

(iii) cause the display device of the additional button to visually indicate second information related to a second play option of the second type of wagering game, the visually indicated second information functioning as a label for the additional button, said second play option being different from the first play option of the first type of wagering game, said second information being different from the first information;

(iv) receive a plurality of input signals including:

(x) at least one input signal resulting from an activation of at least one of the buttons of the set of buttons; and (y) at least one other input signal resulting from an activation of the additional button;

(v) operate the second type of wagering game based, at least in part, on said received input signals in accordance with the second game rules; and (vi) indicate an outcome based on the operation of the second type of wagering game in accordance with the second game pay table.

51. The gaming device of claim 50, wherein the first type of wagering game includes a game selected from the group consisting of a slot game, a blackjack game, a poker game and a keno game.

52. The gaming device of claim 51, wherein the second type of wagering game includes a different game selected from the group consisting of a slot game, a blackjack game, a poker game and a keno game a primary game.

53. The gaming device of claim 50, wherein the display device of the additional button includes a device selected from the group consisting of: (a) a device including at least one light source; (b) a device including a plurality of light sources; (c) a device including an array of light sources; (d) a device including a display panel; and (e) a device including a display panel having a screen.

54. A gaming device operable under control of a processor, said gaming device comprising:

a cabinet having a first cabinet portion and a second cabinet portion positioned below the first cabinet portion;

a game display device mounted to the first cabinet portion;

a set of buttons mounted to the second cabinet portion, the set of buttons being positioned below the game display device, each one of said buttons having a depressible portion movable between a plurality of different positions relative to the second cabinet portion;

an additional button mounted to the second cabinet portion, the additional button being positioned below the game display device, the additional button having:

(a) a depressible portion which is movable, relative to the second cabinet portion, between an extended position and at least one depressible position;

(b) a spring which biases the depressible portion toward the extended position; and (c) a display device other than the game display device, the display device of the additional button having a screen;

a memory device accessible by a server over a network, the server being located remote from the cabinet, the memory device storing a plurality of instructions, the instructions being executable by the processor to operate with the game display device, the set of buttons, and the additional button to:

(a) activate an attract mode before any wagering games are activated, the wagering games including a first type of wagering game and a second type of wagering game;

(b) during the attract mode, cause the display device of the at least one additional button to produce at least one visual output;

(c) receive a signal from the server, the signal being associated with one of: (i) the first type of wagering game, the first type of wagering game having a plurality of first game symbols, a plurality of first game rules, and a first game pay table; and (ii) the second type of wagering game, the second type of wagering game being different from the first type of wagering game, the second type of wagering game having a plurality of second game symbols, a plurality of second game rules, and a second game pay table, the second game symbols being different from the first game symbols, the second game rules being different from the first game rules, the second game pay table being different from the first game pay table;

(d) if the received signal is associated with the first type of wagering game:

(i) end the attract mode and activate the first type of wagering game without activating the second type of wagering game;

(ii) cause the game display device to display the first game symbols;

(iii) cause the display device of the additional button to visually indicate first information related to a first play option of the first type of wagering game, the visually indicated first information functioning as a label for the additional button;

(iv) receive a plurality of input signals including:

(x) at least one input signal resulting from an activation of at least one of the buttons of the set of buttons; and (y) at least one other input signal resulting from an activation of the additional button;

(v) operate the first type of wagering game based, at least in part, on said received input signals in accordance with the first game rules; and (vi) indicate an outcome based on the operation of the first type of wagering game in accordance with the first game pay table;

(e) if the input signal is associated with the second type of wagering game:

(i) end the attract mode and activate the second type of wagering game without activating the first type of wagering game;

(ii) cause the game display device to display the second game symbols;

(iii) cause the display device of the additional button to visually indicate second information related to a second play option of the second type of wagering game, the visually indicated second information functioning as a label for the additional button, said second play option being different from the first play option of the first type of wagering game, said second information being different from the first information;

(iv) receive a plurality of input signals including:

(x) at least one input signal resulting from an activation of at least one of the buttons of the set of buttons; and (y) at least one other input signal resulting from an activation of the additional button;

(v) operate the second type of wagering game based, at least in part, on said received input signals in accordance with the second game rules; and (vi) indicate an outcome based on the operation of the second type of wagering game in accordance with the second game pay table.

55. The gaming device of claim 54, wherein the first type of wagering game includes a game selected from the group consisting of a slot game, a blackjack game, a poker game and a keno game.

56. The gaming device of claim 55, wherein the second type of wagering game includes a game selected from the group consisting of a slot game, a blackjack game, a poker game and a keno game.

57. The gaming device of claim 54, wherein the display device of the additional button includes a device selected from the group consisting of: (a) a device including at least one light source; (b) a device including a plurality of light sources; (c) a device including an array of light sources; (d) a device including a display panel; and (e) a device including a display panel having a screen.

* * * * *

UNITED STATES PATENT AND TRADEMARK OFFICE

CERTIFICATE OF CORRECTION

PATENT NO. : 7,628,692 B2
APPLICATION NO. : 10/227085
DATED : December 8, 2009
INVENTOR(S) : Joseph E. Kaminkow It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 943 days.

Signed and Sealed this

Second Day of November, 2010

David J. Kappos

David J. Kappos
*Director of the United States Patent and Trademark Office*